United States Patent [19]

Gullichsen

[11] Patent Number: 4,854,819

[45] **Date of Patent: * Aug. 8, 1989**

[54] METHOD AND APPARATUS FOR PUMPING FIBRE SUSPENSIONS

[75] Inventor: Johan Gullichsen, Siuntio, Finland

[73] Assignee: A. Ahlstrom Corporation, Karhula, Finland

[ * ] Notice: The portion of the term of this patent subsequent to Oct. 25, 2005 has been disclaimed.

[21] Appl. No.: 131,128

[22] Filed: Dec. 10, 1987

Related U.S. Application Data

[60] Continuation of Ser. No. 848,754, Apr. 4, 1986, Pat. No. 4,780,053, and a continuation-in-part of Ser. No. 275,756, Jun. 22, 1981, abandoned, which is a continuation-in-part of Ser. No. 79,225, Sep. 26, 1979, abandoned, which is a division of Ser. No. 903,494, May 8, 1978, abandoned.

[30] Foreign Application Priority Data

Apr. 10, 1978 [FI] Finland ..... 781071

[51] Int. Cl.[4] ..... F04D 1/10

[52] U.S. Cl. ..... 415/143

[58] Field of Search ..... 415/121 B, 143; 366/262, 263, 264, 265, 302, 307

[56] References Cited

U.S. PATENT DOCUMENTS

| | | | |
|---|---|---|---|
| 3,284,055 | 11/1966 | Johansen | 415/143 |
| 3,692,422 | 9/1972 | Girardier | 415/121 B |
| 4,019,829 | 4/1977 | Knopfel et al. | 415/143 |
| 4,275,988 | 6/1981 | Kalashnikov et al. | 415/143 |
| 4,426,190 | 1/1984 | Shapiro et al. | 415/143 |
| 4,435,122 | 3/1984 | Niskanen et al. | 415/121 B |
| 4,619,736 | 10/1986 | Henricson et al. | 415/121 B |
| 4,637,779 | 1/1987 | Sherman et al. | 415/143 |
| 4,770,604 | 9/1988 | Luthi et al. | 415/143 |

FOREIGN PATENT DOCUMENTS

| | | | |
|---|---|---|---|
| 501662 | 6/1930 | Fed. Rep. of Germany | 415/143 |
| 2107069 | 8/1972 | Fed. Rep. of Germany | 415/121 B |
| 14543 | 6/1969 | Japan | 415/213 A |
| 523195 | 8/1976 | U.S.S.R. | 415/143 |
| 687266 | 9/1979 | U.S.S.R. | 415/143 |

*Primary Examiner*—Robert E. Garrett
*Assistant Examiner*—John T. Kwon
*Attorney, Agent, or Firm*—Cohen, Pontani & Lieberman

[57] ABSTRACT

A method and a device for pumping fibre suspensions of high consistency are described. Shear forces disrupting fibre flocs are induced in the front of the impeller in a centrifugal pump which fluidize the fibre suspension thus converting it into an easily pumpable state. This is effected by an inlet part of the pump having recesses and/or lobes in its inner surface in front of the impeller which cooperate with a rotor having an outer surface in which there are lobes. The rotor is disposed into the outlet part of the vessel during operation.

4 Claims, 4 Drawing Sheets

FIG. 2
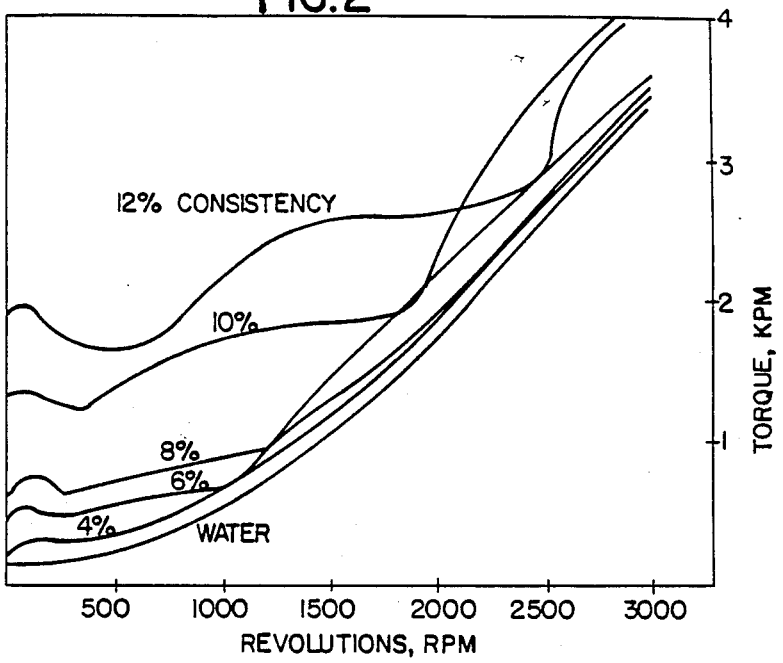
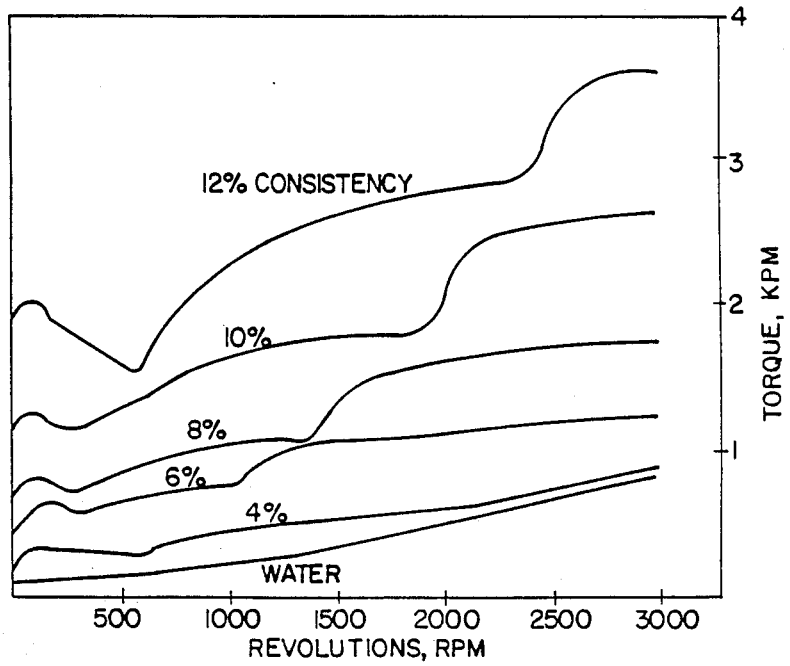
FIG. 3

METHOD AND APPARATUS FOR PUMPING FIBRE SUSPENSIONS

This is a continuation, of application Ser. No. 848,754, filed Apr. 4, 1986, now patented U.S. Pat. No. 4,780,053, and a continuation-in-part of U.S. Ser. No. 275,756 filed June 22, 1981, abandoned, which is a continuation-in-part of U.S. Ser. No. 079,225, filed Sept. 26, 1979, now abandoned. Ser No. 079,225 was a divisional of U.S. Ser. No. 903,494, filed May 8, 1978. Ser. No. 903,494 has now been abandoned.

The present invention relates in general to a method and an apparatus for pumping fibre suspensions and is particularly intended to be applied to centrifugal pumps for pumping fibre suspensions of high consistency.

Centrifugal pumps can successfully be used in the paper and cellulose industry for pumping fibre suspensions or pulps having consistencies less than 6% on condition that the pump has been correctly designed and that its input pressure is adequately high. A centrifugal pump is not, however, suitable for high consistency pulps because due to flocculation of the pulp, the pump has a tendency to become clogged. Expensive pumps based on the displacement principle must therefore be used for pumping high-consistency pulps.

It should be stressed that in a fiber suspension of consistency above 6%, the fibers tend to form flocs which interlock to form a coherent network which goes through a pipe like a solid, giving plug flow. Most experiments with high consistency pulps have been carried out in an effort to achieve a high degree of agitation and turbulence so that air bubbles are prevented from building up ahead of the impeller inlet. Undoubtedly, this gives some advantages, but agitation requires high energy expenditure.

It is an object of the invention to provide a method and an apparatus which makes it possible to use centrifugal pumps for pumping pulps of considerably higher consistencies than until now.

Another object of the present invention is to subject the pulp suspension to such shear forces that fluidization is achieved. The method and apparatus according to the present invention are based on the finding that at a high shear rate, flocs are dislodged from the network and disrupted, so that the pulp is converted into an easily pumpable form because it is fluidized. Fluidization is the state where solid particles can move freely past each other. In a pulp susension in water, the solid fibers are converted into such as state that the fiber-to-fiber bonds are disrupted and the suspension behaves in a manner similar to a uniform liquid.

The state of fluidization with the apparatus according to the present invention is achieved by subjecting the pulp to shear stresses which disrupt the fiber-to-fiber bonds by causing the pulp to go through a flow passage formed by a non-round rotor having rib-shaped lobes, and the outlet part of the vessel and the inlet part of the pump, the cross-section of which alternately decreases and increases so that flow components directed alternately towards the rotational axis of the rotor and away from it are formed when the rotor rotates. Another feature of the method and apparatus according to the present invention is that the outlet of the pulp vessel is non-round, and is provided with a non-round discontinuous surface. More specifically, the outlet of the pump vessel has recesses or rib-shaped lobes.

According to the invention, fluidization is achieved by generating shear forces in the pump in front of the impeller which disrupt fiber agglomerations or flocs formed in the fiber suspension. The invention is based on the fact that the fiber suspension, when being subjected to forces disrupting fiber-to-fiber bondings, becomes fluidized, i.e. is converted into an easily pumpable state. Compared to a conventional centrifugal pump, a pump according to the invention operates at a lower inlet pressure.

An apparatus according to the invention can e.g. be used for discharging pulps of consistencies from 5% to 25% from pulp vessels and in any event higher than 6%. According to known methods, pulp is discharged from a vessel by mechanical devices such as transport screws or rotating scrapers. Discharge of high-consistency pulps requires much energy and robust constructions. Vibrating devices e.g. based on ultrasonic waves have been suggested to be used for discharging pulps from vessels but in practice these have been proved ineffective. When high-consistency pulps are discharged from large vessels, the pulp is usually diluted in front of the outlet in order to make it flow out.

According to the invention, the pump is disposed into the outlet of the pulp vessel so that a rotor running through the inlet part of the pump and the outlet of the pulp vessel, extends into the vessel so that it fluidizes the pulp and the pulp can flow into the pump underneath due to gravitational forces.

Another feature of the present invention resides in providing a rotor with ribs while the outlet of the pulp vessel may have recesses or ribs.

The invention described in more detail below with reference to the enclosed drawings in which:

FIG. 2 is a plot of torques on the ordinate and rotational speeds on the abscissa in experiments according to the present invention with the apparatus according to FIG. 1.

FIG. 3 is a plot of torques on the ordinate and rotational speed on the abscissa in experiments with an apparatus having a rotor without ribs, not in accordance with the invention, for comparison purposes.

Figure 4:
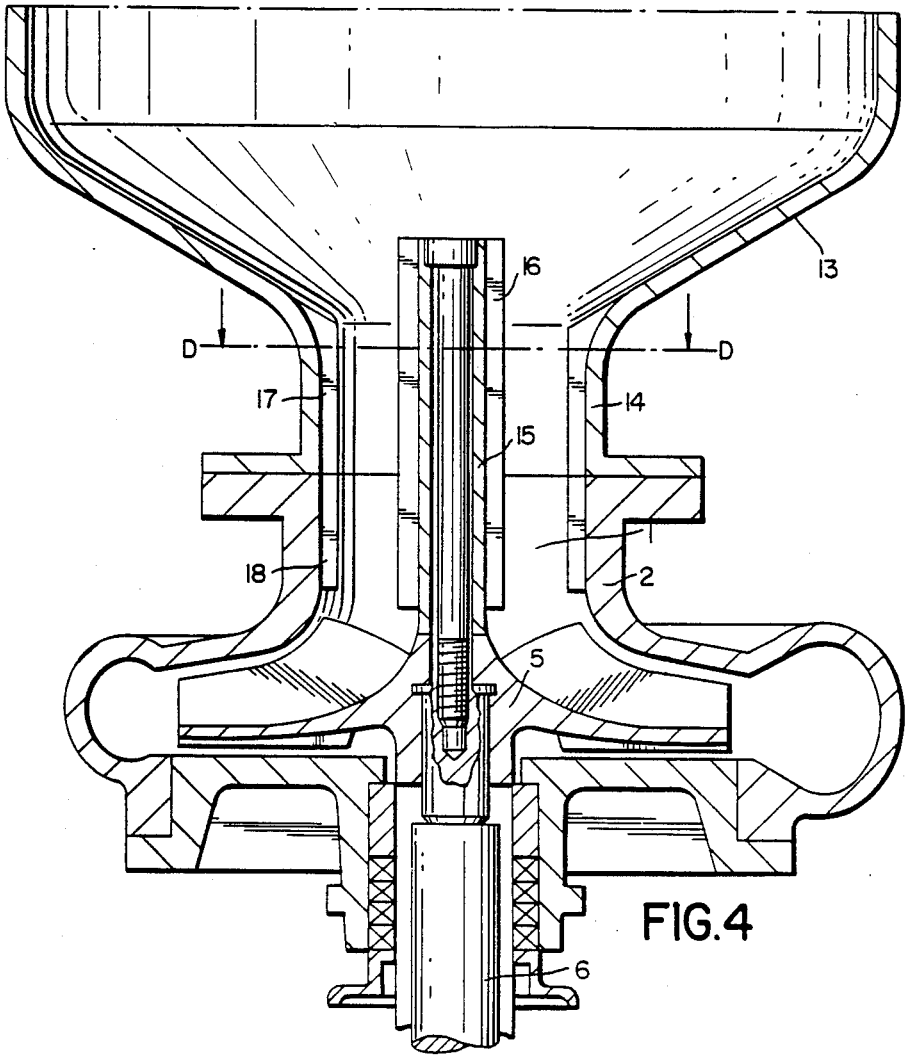
FIG. 4 shows a vertical sectional view of the embodiment of the apparatus according to the invention illustrated in FIG. 1. The apparatus of FIG. 1 is a cross-section of the apparatus taken along the line D—D of FIG. 4.
Figure 5:
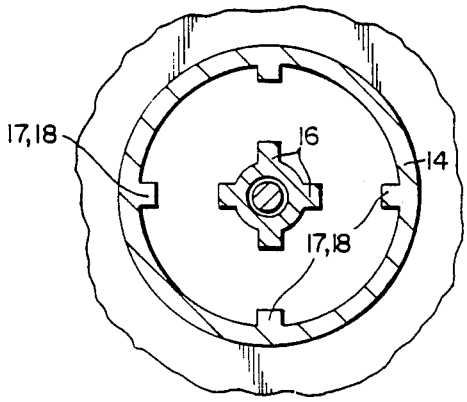
FIG. 5 shows another cross-section.

FIGS. 4 and 5 show an embodiment of the invention where the inlet part 2 of the pump is connected to the outlet of the pulp vessel 13, in order to remove pulp from the vessel. A rotor 15 running through the inlet part of the pump and the outlet of the pulp vessel has been mounted on the same shaft 6 as the impeller 5. The rotor is provided with rib-shaped lobes 16 and the outlet of the pulp vessel is provided with rib-shaped lobes 17, 18 the main direction of which is axial.

If necessary the pulp vessel may be provided with several outlets each of which is connected to a pump.

According to one embodiment, the rotor in front of the impeller can rotate at a different angular speed than the impeller 5.

In the fiber suspension flow components alterate in direction and deviate from the main flow direction so that shear forces are generated disrupting the fiber-to-fiber bondings as the width of the flow passage between the rotor and the outlet part of the vessel and the inlet part of the pump alternately increases and decreases when the rotor rotates. The result is that the fiber suspension becomes fluidized and its flow resistance decreases.

While the rotor rotates, the fiber suspension in front of the outlet of the vessel is also subjected to shear forces by the part of the rotor extending into the vessel. Therefore, the fiber suspension becomes fluidized just in front of the outlet and flows unhindered from the vessel to the impeller.

EXAMPLE 1

Figure 1:
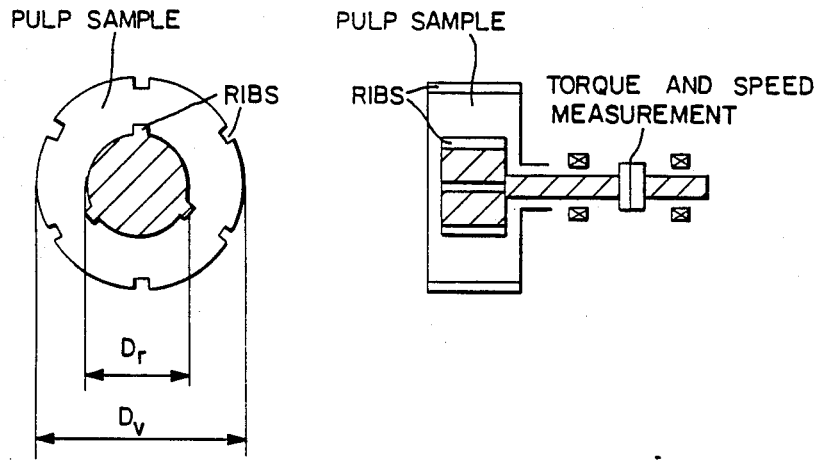
FIG. 1 illustrates an apparatus according to the present invention used to make torque measurements. The apparatus comprises a vessel provided with a rotor having external ribs.

A device according to FIG. 1 was used which comprises a rotor provided with ribs. The rotor was disposed in the pulp vessel. The rotor was mounted on a shaft extending through the wall of the vessel. Means for measuring the torque and the rotational speed of the shaft were provided. The end plate of the vessel was transparent to allow visual observation. Detailed motional patterns could be studied by colouring the liquid.

Two series of tests were carried out with the vessel filled by pulp having a consistency of 4, 6, 8, 10 and 12%, one using a vessel provided with internal ribs and one without ribs. Comparative tests were carried out with the vessel filled with water. A shear stress field was generated between the rotor and the vessel wall by rotating the rotor. The torque versus the rotational speed was recorded for the vessel having internal ribs (FIG. 2) and for the vessel without ribs (FIG. 3).

The rotor diameter $D_r$ was 100 mm., the vessel diameter $D_v$ 213 mm. and the height of the ribs was 10 mm.

As shown in FIG. 2, in the vessel having internal ribs, the torque (shear stress) rapidly increased. When a transition point onset of fiber-network disruption was reached, high shear stress ratios are generated at relatively low rotational speeds. In the vessel without ribs, much higher rotational speeds were needed in order to bring about the same shear stress ratios.

To disrupt the fiber-network, i.e. to fluidize the pulp, a shear stress exceeding a critical value which depends on the consistency and the pulp quality has to be brought about. In a vessel having internal ribs fully developed fluidization may therefore be achieved by using less power than in a vessel without ribs.

FIG. 3 shows the fact that fiber network disruption could not be reached without the ribs on the vessel wall with available rotor speeds, since the curves for fiber suspensions did not approach the water curve as in FIG. 2.

EXAMPLE 2

The apparatus of FIGS. 4 and 5 was used. A pump essentially as presented in FIGS. 4 and 5 was installed vertically to the bottom of a fullscale down flow storage tower and stock was discharged and pumped further at 12% consistency without prior dilution against a considerable pressure. The following data were measured:

| | | Range |
|---|---|---|
| Flow | 1/min | 500–7500 |
| Consistency | % | 11–12 |
| Production | tadp/d | 100–1400 |

-continued

| | | Range |
|---|---|---|
| Pump Head | bar | 6.0–7.0 |
| Level in tank | m | 2–16 |

These results clearly demonstrate the operability of the apparatus of this invention.

Figure 6:
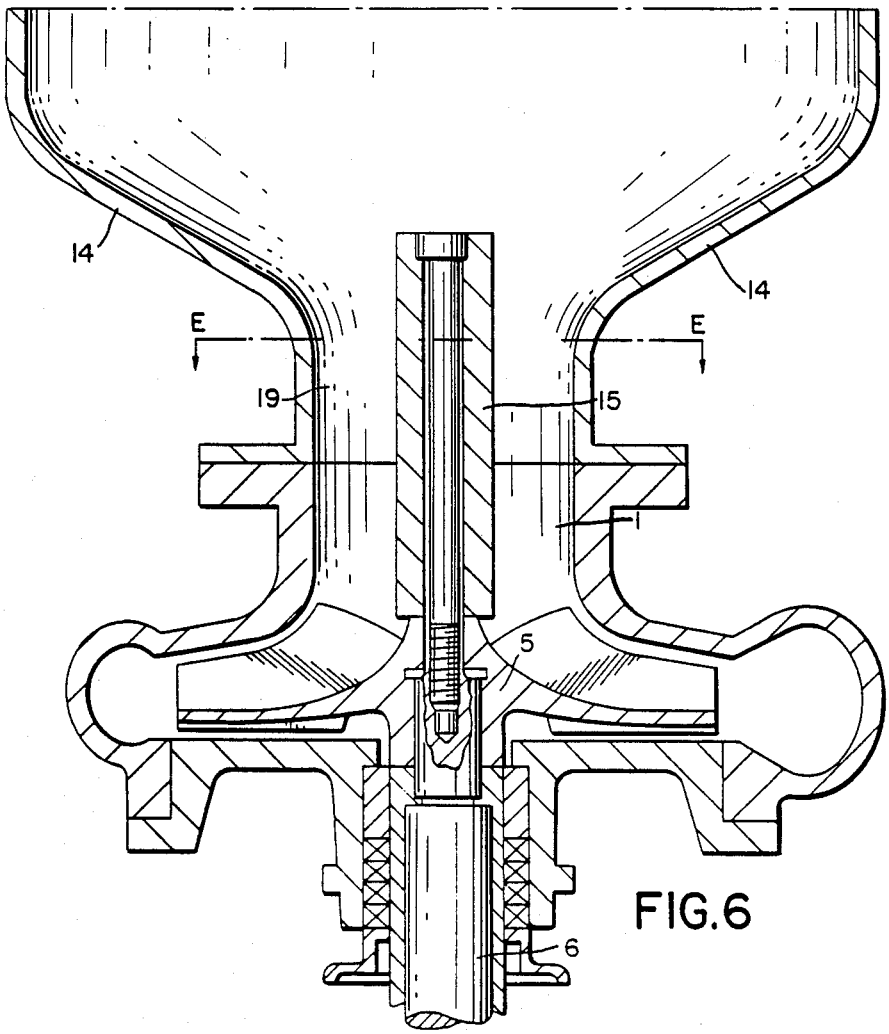
FIG. 6 and 7 show another embodiment of the apparatus of this invention.
Figure 7:
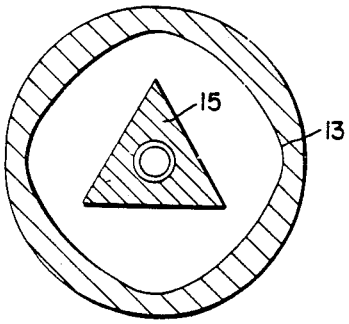

In the embodiment of FIGS. 6 and 7, numeral 14 is the wall of the outlet duct of the vessel. Numeral 19 is the outlet itself, that is the space surrounded by the wall 14. Rotor 15 has a triangular cross-section and is mounted in front of impeller 5. The rotor is placed in the outlet 19. The outlet has a quadrangular, slightly curved cross-section. Also in this embodiment, the cross-section of the duct through which the pulp flows, alternately decreases and increases in the direction of rotation so that shear forces are generated and the pulp is fluidized. To state the matter in different words, the rotational motion of pulp has alternate flow components towards and away from the rotational axis of the rotor.

What is claimed is:

1. A method for fluidizing a high consistency fiber suspension stored in a vessel having an outlet and for pumping said fiber suspension in the fluidized state by a centrifugal pump including a housing having an inlet, an impeller disposed in said housing, and a non-circular rotor mounted for rotation within said housing inlet, said method comprising the following steps:

(a) connecting said pump housing inlet to said vessel outlet;

(b) rotating said rotor at a speed sufficient to generate a shear force field within said suspension, said shear force field being generated in said pump housing inlet and in said vessel and being of sufficient strength to fluidize said suspension in said housing inlet and said vessel adjacent said housing inlet;

(c) rotating said impeller; and (d) discharging said fluidized suspension from said pump.

2. A centrifugal pump for fluidizing a high consistency fiber suspension stored in a vessel having an outlet and for pumping the fiber suspension in the fluidized state, said pump comprising:

(a) a pump housing having an inlet connectable with said vessel outlet;

(b) an impeller mounted within said housing for discharging said fluidized suspension;

(c) a shaft operatively connected to said impeller;

(d) a non-circular rotor mounted for rotation within said inlet for generating a shear force field of sufficient strength to fluidize said suspension in said housing inlet and in said vessel adjacent said pump housing inlet.

3. In combination a vessel for holding a fiber suspension and a centrifugal pump for fluidizing and pumping the fiber suspension therefrom comprising:

(a) a vessel outlet;

(b) a pump housing having a suspension inlet part connected to said vessel outlet for allowing said suspension to pass into said housing;

(c) said housing further having a suspension outlet;

(d) an impeller mounted within said housing for discharging said suspension through said housing outlet;

(e) a shaft operatively connected to said impeller;

(f) a non-circular rotor mounted for rotation within said inlet part for generating a shear force field of sufficient strength to fluidize said suspension in said inlet part and in said vessel adjacent said vessel outlet.

4. A centrifugal pump for fluidizing a high consistency fiber suspension stored in a vessel having an outlet and for pumping said fiber suspension in the fluidized state, said pump comprising:

(a) a pump housing having an inlet connectable with said vessel outlet;

(b) an impeller disposed within said housing for discharging said fluidized suspension;

(c) a shaft operatively connected to said impeller;

(d) a non-circular rotor; mounted for rotation within said pump housing inlet;

(e) said inlet and said rotor defining and being spaced apart by a space, at least one of the surfaces defining said space being non-circular for generating a shear force field, said shear force field extending through said pump housing inlet into said vessel adjacent said inlet and being of sufficient strength to disrupt the fiber-to-fiber bonds of said fiber suspension for fluidizing said suspension and rendering said suspension pumpable.

* * * * *